US006166616A

United States Patent [19]

Fischer et al.

[11] Patent Number: 6,166,616

[45] Date of Patent: Dec. 26, 2000

[54] CIRCUIT BREAKER WITH TRIP BAR REINFORCING CLIP

[75] Inventors: Kenneth Martin Fischer, Finleyville; Mark Owen Zindler, Pittsburgh, both of Pa.

[73] Assignee: Eaton Corporation, Cleveland, Ohio

[21] Appl. No.: 09/448,047

[22] Filed: Nov. 23, 1999

[51] Int. Cl.[7] ..... H01H 9/00

[52] U.S. Cl. ..... 335/172; 335/167

[58] Field of Search ..... 335/16, 8, 6, 10, 335/35, 42, 167–176

[56] References Cited

U.S. PATENT DOCUMENTS

| | | | |
|---|---|---|---|
| 3,467,920 | 9/1969 | Hall et al. | 335/35 |
| 4,128,822 | 12/1978 | Peterson, Jr. | 335/8 |
| 4,929,919 | 5/1990 | Link et al. | 335/38 |
| 5,341,191 | 8/1994 | Crookston et al. . | |
| 5,705,968 | 1/1998 | Beck et al. . | |
| 5,831,501 | 11/1998 | Kolberg et al. . | |
| 5,831,503 | 11/1998 | Beck et al. . | |
| 5,898,146 | 4/1999 | Beck et al. . | |

*Primary Examiner*—Lincoln Donovan
*Assistant Examiner*—Tuyen T. Nguyen
*Attorney, Agent, or Firm*—Martin J. Moran

[57] ABSTRACT

An electrical circuit breaker comprises a housing; separable contacts housed within the housing and moveable between a closed position and an open position; an operating mechanism for moving the separable contacts between the closed position and the open position thereof, the operating mechanism having a first position and a second position corresponding to the open position of the separable contacts; a latch for latching said operating mechanism in the first position thereof and for releasing the operating mechanism to the second position thereof; a trip bar movable in a first direction and a second direction for unlatching said latch, the trip bar including first and second pivot pockets for pivotally mounting the trip bar within the housing; a sensor for sensing an electrical condition associated with the separable contacts and for moving the trip bar in the second direction in order to unlatch the latch, to release the operating mechanism to the second position thereof, and to move the separable contacts to the open position thereof; and first and second clips respectively positioned in the first and second pivot pockets for providing bearing surfaces in the trip bar.

12 Claims, 4 Drawing Sheets

CIRCUIT BREAKER WITH TRIP BAR REINFORCING CLIP

BACKGROUND OF THE INVENTION

This invention is directed to electrical circuit breakers and, more particularly, to electrical circuit breakers having a trip mechanism controlling the operation of the circuit breaker, wherein the trip mechanism includes a tip bar.

Circuit breakers are generally old and well known in the art. Examples of circuit breakers are disclosed in U.S. Pat. Nos. 5,705,968; 5,831,503; and 5,341,191. Such circuit breakers are used to protect electrical circuitry from damage due to an overcurrent condition, such as an overload condition or a relatively high-level short circuit condition.

Molded case circuit breakers include a pair of separable contacts per phase which may be operated either manually by way of a handle located on the outside of the case or automatically in response to an overcurrent condition. Circuit breakers include an operating mechanism that is designed to rapidly open and close the separable contacts, thereby preventing a moveable contact from stopping at any position which is intermediate to a fully open or a fully closed position. The circuit breaker also includes a trip mechanism having a means for sensing an overcurrent condition in the automatic mode of operation; a trip bar responsive to the sensing means; and a latch mechanism including a trigger mechanism. During an overcurrent condition, the trip bar responds to the sensing means and releases the trigger mechanism. The trigger mechanism releases a latching and releasing mechanism, which, in turn, opens the separable contacts.

The trip bar of the trip mechanism is rotatable by one or more trip sources to release the trigger mechanism. "Latch load" is conventionally defined as the force required by a test probe at a trip point on the trip bar, such as the actuation point for accessory attachments, to cause sufficient torque about the axial centerline of the trip bar necessary to release the trigger mechanism. At least two other torques are present on the trip bar during a tripping action.

First, there is a frictional torque resisting rotation of the trip bar due to friction between the trip bar and the operating mechanism side plates at the trip bar pivot points. The second torque is due to the load imposed by the trigger mechanism on the trip bar at a loading point. This torque tends to push the trip bar "off latch". The force associated with this torque is dependent upon many variables within the circuit breaker operating mechanism (e.g., biasing spring force, parts tolerance) which are normal manufacturing variables.

With suitable moments, a force (e.g., about 300 pounds) in the operating mechanism may be offset by a relatively small load (e.g., about 30 ounces) where a plunger engages the trip bar, thereby controlling a relatively large force with a relatively small force. As a result, even relatively small position variations in the latching and releasing mechanism may cause significant changes in the direction of the operating force. This, in turn, reflects directly in the corresponding latch load and "shock-out" sensitivity (i.e., the sensitivity of the operating mechanism to a premature release). The corresponding latch load may be subject to a relatively large amount of variation due to the various positions assumed by components of the operating mechanism and the latching and releasing mechanism resulting from: (1) normal manufacturing tolerances; (2) production heat-treating operations; and (3) normal operating variations between latching operations.

Sufficient latch load is required in order to maintain the circuit breaker operating mechanism in the latched position. Too little load may cause the operating mechanism to shock-out. For example, if the corresponding latch load is too small, the operating mechanism may shock-out to a trip position when the circuit breaker handle is moved to the ON position. Also, manual "push-to-trip" operation of the circuit breaker may be adversely affected in the OFF position of the operation mechanism. In such OFF position, the force of the operating mechanism is further reduced because a spring of the operating mechanism may be stretched less with respect to the ON position. In turn, the corresponding reduced latch load may be insufficient to overcome the normal frictional forces within the operating and trip mechanisms. Conversely, relatively large latch loads may inhibit the automatic mode of operation during an overcurrent condition. Too much load may prevent the operating mechanism from tripping after an overload or short circuit event is detected in the circuit breaker trip unit and a trip initiation is begun. Excessive load may also prevent accessory attachments, such as shunt trips or undervoltage releases, from causing the operating mechanism to trip when appropriate.

In conventional practice, a circuit breaker is assembled and the latch load is measured to ensure that it falls within specified limits. The range of these limits tends to be rather wide in order to increase manufacturing yield. If the latch load is out of specification, the usual remedy is to substitute a new trip bar bias spring and/or manually stretch the bias spring, bend it, or cut one or more coil turns from it. In some cases, the circuit breaker trip bar is replaced or scrapped. These remedies all require a certain degree of disassembly and are costly in terms of labor and materials.

One known trip bar includes pivot pockets that receive pivot points on side plates of the circuit breaker. After repeated operation, the pivot pocket can become worn and distorted, thereby shifting the location of the latch relative to the trigger.

There is a need, therefore, for a way to reduce wear in the pivot pockets of the circuit breaker trip bar to improve the operating life of the trip bars.

SUMMARY OF THE INVENTION

An electrical circuit breaker comprises a housing; separable contacts housed within the housing and moveable between a closed position and an open position; an operating means for moving the separable contacts between the closed position and the open position thereof, the operating means having a first position and a second position corresponding to the open position of the separable contacts; a latch for latching the operating means in the first position thereof and for releasing the operating means to the second position thereof; a trip bar movable in a first direction and a second direction for unlatching the latch, the trip bar including first and second pivot pockets for pivotally mounting the trip bar within the housing; a sensor for sensing an electrical condition associated with the separable contacts and for moving the trip bar in the second direction in order to unlatch the latch, to release the operating means to the second position thereof, and to move the separable contacts to the open position thereof, and first and second clips respectively positioned in the first and second pivot pockets for providing bearing surfaces in the trip bar.

BRIEF DESCRIPTION OF THE DRAWINGS

A full understanding of the invention can be gained from the following description of the preferred embodiment when read in conjunction with the accompanying drawings in which.

DESCRIPTION OF THE PREFERRED EMBODIMENT

Figure 1:
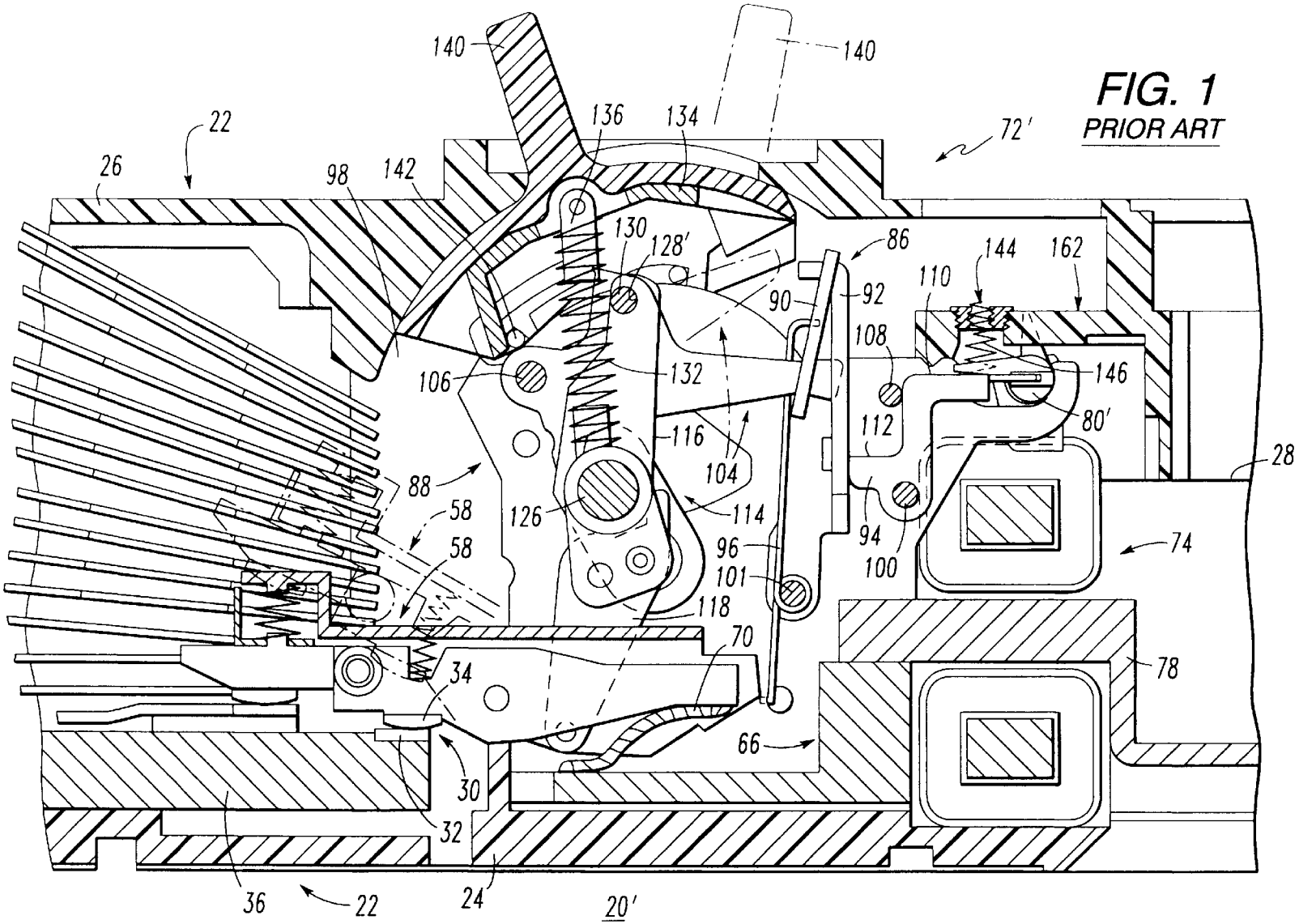
FIG. 1 PRIOR ART
FIG. 1 is a vertical sectional view of a prior art molded case circuit breaker.

Referring to the drawings, FIG. 1 shows a molded case three phase circuit breaker 20' as described in U.S. Pat. No. 5,705,968, that comprises an insulated housing 22, formed from a molded base 24 and a molded cover 26, assembled at a parting line 28, although the principles of the present invention are applicable to various types of electrical switching devices and circuit interrupters.

The circuit breaker 20' also includes at least one pair of separable main contacts 30 per phase, provided within the housing 22, which includes a fixed main contact 32 and a movably mounted main contact 34. The fixed contact 32 is carried by a line side conductor 36, electrically connected to a line side terminal (not shown) for connection to an external circuit (not shown). A movably mounted main contact arm assembly 58 carries the movable contact 34 and is electrically connected to a load conductor 66 by way of a plurality of flexible shunts 70. A free end (not shown) of a load conductor 78 connected to the load conductor 66 acts as a load terminal for connection to an external load, such as a motor.

An electronic trip unit 72' includes, for each phase, a current transformer (CT) 74 for sensing load current. The CT 74 is disposed about the load conductor 78 and, in a manner well known in the art, detects current flowing through the separable contacts 30 in order to provide a signal to the trip unit 72' to trip the circuit breaker 20' under certain conditions, such as a predetermined overload condition. The trip unit 72' includes a trip bar 80' and a latch assembly 86. The trip bar 80' has an integrally formed extending trip lever 82 (shown in FIG. 2) mechanically coupled to an undervoltage trip assembly (not shown) which cooperates to rotate the trip bar 80' clockwise (with respect to FIG. 1) during predetermined levels of overcurrent.

Figure 2:
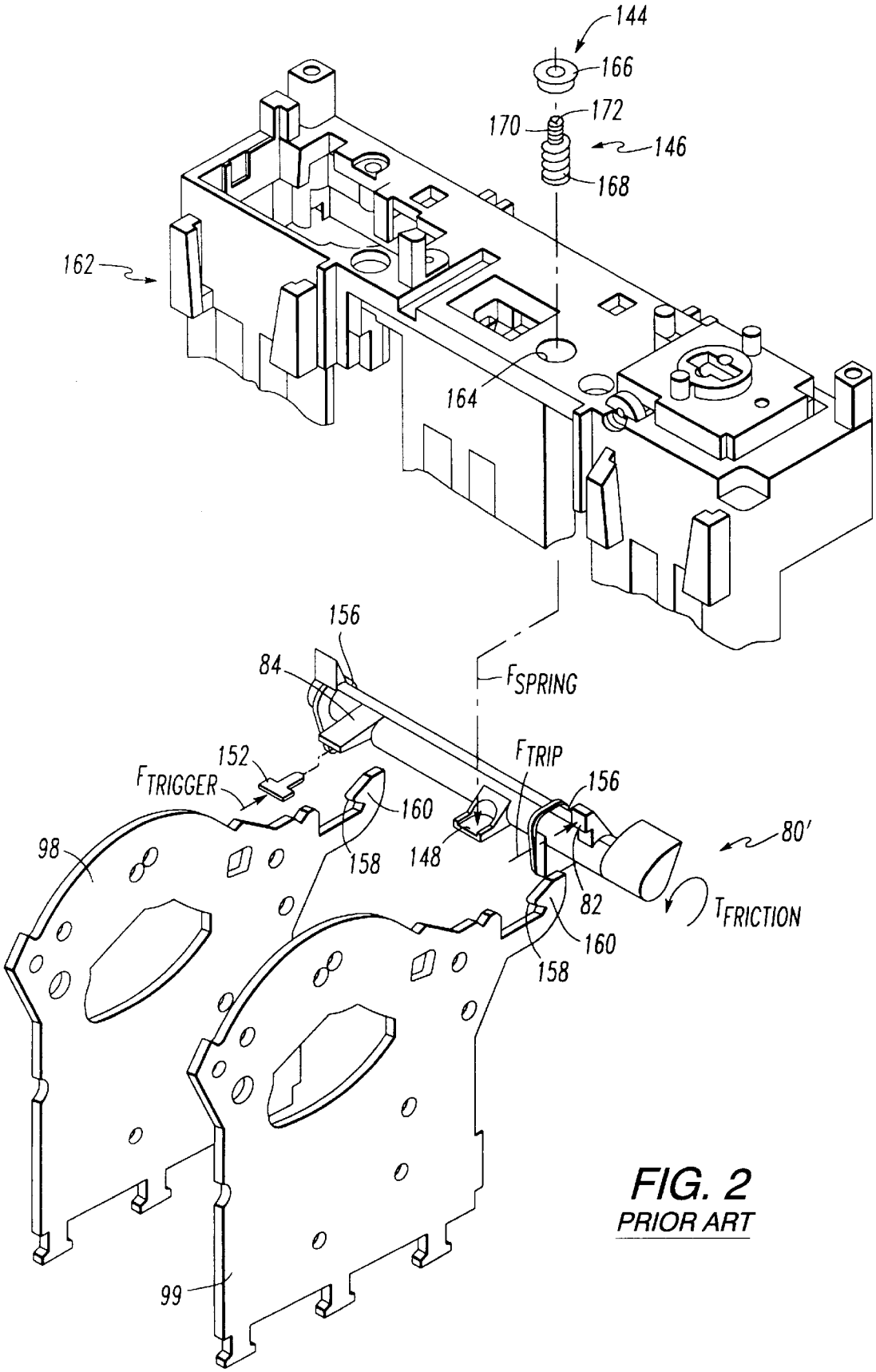
FIG. 2 PRIOR ART
FIG. 2 is an exploded isometric view, with some parts not shown for clarity, of the trip bar mounting assembly of FIG. 1.

The latch assembly 86 latches the operating mechanism 88 during conditions when the circuit breaker 20' is in an ON position (shown in solid in FIG. 1) and a non-trip OFF position (partially shown in phantom line drawing with the arm assembly 58). During an overcurrent condition, the trip unit 72', and more specifically the trip bar 80', releases the latch assembly 86 to allow the circuit breaker 20' to trip. The latch assembly 86 includes a reset plate 90, a pivotally mounted lock plate 92, a latch lever trigger assembly 94, and a biasing spring 96. The lock plate 92 is pivotally mounted to a pair of spaced apart side plates 98 and 99 (both are shown in FIG. 2), used to carry the operating mechanism 88, by way of a pin 101. The reset plate 90 is coupled to the lock plate 92 at one end. The other end of the lock plate 92 is mounted for arcuate movement within the side plates 98, 99. The lock plate 92 includes a pair of spaced apart notches (not shown) for latching a cradle mechanism 104 that forms a portion of the operating mechanism 88. The biasing spring 96 biases the reset plate 90 and the lock plate 92 counterclockwise (with respect to FIG. 1).

The operating mechanism 88 has a latched position (shown in solid in FIG. 1) provided by the latch assembly 86. Upon clockwise rotation of the trip bar 80', an insert 152 (shown in FIG. 2) beneath a latch lever 84 (shown in FIG. 2), integrally formed on the trip bar 80', releases the trigger assembly 94. In turn, the trigger assembly 94 releases the latch assembly lock plate 92 which, in turn, releases the operating mechanism 88 to the unlatched position thereof (partially shown in phantom line drawing in FIG. 1 with the cradle mechanism 104) in order to move the separable contacts 30 to the trip open position thereof, thereby allowing the circuit breaker 20' to trip.

The trigger assembly 94 is pivotally mounted to one of the side plates 99 by the pin 100 and is biased in a counterclockwise direction (with respect to FIG. 1) by a torsion spring (not shown). A stop pin 108 serves to limit rotation of the trigger assembly 94. The trigger assembly 94 is integrally formed with an upper latch portion 110 and a lower latch portion 112. The lower latch portion 112 is adapted to engage the lock plate 92. The upper latch portion 110 is adapted to communicate with the insert 152 (shown in FIG. 2) of the trip bar 80'.

The operating mechanism 88 moves the separable main contacts 30 between the closed and open positions thereof and, thus, facilitates opening and closing the separable contacts 30. The operating mechanism 88 includes a toggle assembly 114 which has a pair (only one is shown in FIG. 1) of upper toggle links 116 and a pair (only one is shown in FIG. 1) of lower or trip links 118. Each of the upper toggle links 116 receives a crossbar 126 and is provided with a hole 128' that allows it to be mechanically coupled to the cradle mechanism 104 by way of a pin 130. Operating springs 132 are connected between the crossbar 126 and a handle yoke assembly 134 by way of spring retainers 136.

The cradle mechanism 104 is pivotally connected to the side plates 98, 99 by way of a pin 106. The cradle mechanism 104, in cooperation with the latch assembly 86, allows the circuit breaker 20' to be tripped by way of the trigger assembly 94 of the trip unit 72'. In order to reset the cradle mechanism 104, it is necessary to rotate the operating handle 140 toward the off position (shown in phantom line drawing in FIG. 1). The operating handle 140, in cooperation with the handle yoke 134 and a reset pin 142 driven by the yoke 134, allows the cradle mechanism 104 to be moved clockwise (with respect to FIG. 1) and latched relative to the latch assembly 86.

The housing 22, separable contacts 30, operating mechanism 88, operating handle 140 and handle yoke 134, and trip unit 72' excluding the trip bar 80' are disclosed in greater detail in U.S. Pat. No. 5,341,191. The present invention provides improvements disclosed herein in connection with the trip bar 80'.

The trip bar 80' is rotatable in the counterclockwise direction under the bias of the mechanism 144 and in the clockwise direction as discussed above. The trip unit 72' senses an electrical condition, such as an overcurrent condition, associated with the separable contacts 30 and rotates the trip bar 80' in the clockwise rotational direction in order to unlatch the latch assembly 86, release the operating mechanism 88 to the unlatched position thereof, and move the separable contacts 30 to the open position thereof, although the invention is applicable to a wide range of such sensed electrical conditions (e.g., an undervoltage condition, a trip condition detected by an external shunt trip device which remotely trips the circuit breaker 20').

FIG. 2 illustrates the exemplary plastic molded trip bar 80' of the trip unit 72' of FIG. 1 and the adjustable bias spring mechanism 144 having an adjustable helical compression bias spring 146. The elongated trip bar 80' has a transverse member or paddle 148. The paddle 148 is the point of actuation of the bias spring 146 upon the trip bar 80' which is biased by the spring 146 in the counterclockwise direction (with respect to FIG. 2). The elongated spring 146 is generally normal to the trip bar 80'. The trip bar 80' also has the insert 152 (shown in FIG. 2), which is engaged by the latch assembly 86 of FIG. 1, and the trip lever 82, which is engaged by a plunger, such as a trip pin plunger (not shown), to rotate the trip bar 80' in the clockwise direction (with respect to FIG. 2) in order to unlatch the latch assembly 86. The exemplary steel latch insert 152 is assembled into a diametrical hole in the trip bar 80'. Two recesses 156 (best shown in FIG. 3) retain the trip bar 80' axially in the side plates 98, 99 which provide pivot points 158 for rotation of the trip bar 80' on side plate ears 160.

An internal deck or molded housing member 162 of the housing 22 of FIG. 1 has an opening 164. A threaded insert 166 is rigidly pressed into the opening 164 or is suitably molded into place in the deck 162. A portion of the bias spring 146 engages the internal thread of the insert 166 at about the opening 164 of the deck 162. The exemplary bias spring 146 has a major diameter 168 and a minor diameter 170 with a spring end 172 turned in toward the center of the body of the minor diameter 170. Preferably, the wire size and minor diameter 170 of the bias spring 146 are selected to allow such diameter 170 to wind snugly into the internal thread of the insert 166, with the pitch of the diameter 170 being slightly shorter than the pitch of the internal thread. The trip bar 80' is assembled into the two side plates 98, 99 supported by the side plate ears 160. The deck 162, the bias spring 146 and the insert 166 are assembled over the trip bar 80' and side plates 98, 99 in order that the end of the major diameter 168 of the bias spring 146 engages the paddle 148 of the trip bar 80'. Still referring to FIG. 2, the minor diameter upper portion 170 of the spring 146 is biased with respect to and engages the insert 166 of the deck 162 at about the opening 164 thereof. The lower portion 168 of the spring 146 engages and biases the paddle 148 of the trip bar 80'. The upper spring end 172 forms a cross member adjacent the opening 164 of the deck 162. The cross member is rotatable by a suitable adjustment member (not shown) through the opening 164 in order to adjust the length of the bias spring 146 and, hence, the bias on the paddle 148 of the trip bar 80'.

Referring again to FIG. 2, the forces involved in determining latch load are illustrated. The latch load is typically measured as the force, $F_{TRIP}$, required by a test probe (not shown) at trip lever 82 (i.e., the actuation point of accessory attachments to the circuit breaker 20' of FIG. 1) on the trip bar 80' to cause the clockwise torque about the axial centerline of the trip bar 80' necessary to release the trigger assembly 94. There are three other torques present on the trip bar 80' during a tripping action. First, there is a counterclockwise torque, $F_{FRICTION}$, resisting clockwise rotation of the trip bar 80' due to friction between the trip bar 80' and the side plates 98, 99 at the pivot points 158. In prior art circuit breakers, a tetrafluoroethylene (which is sold under the trade designation, "Teflon") based grease or another suitable lubricant has been employed in the recesses 156 of the trip bar 80' to minimize friction at the pivot points 158. The second torque is due to the load, $F_{TRIGGER}$, imposed by the trigger assembly 94 on the latch insert 152. This is a clockwise torque, tending to push the trip bar 80' "off latch". Preferably, this clockwise torque is minimized to reduce shock-outs. The force $F_{TRIGGER}$ is dependent upon many variables within the operating mechanism 88 of FIG. 1 (e.g., toggle spring force, parts tolerance) which are normal manufacturing variables. The third torque imposed on the trip bar 80' is counterclockwise due to the force, $F_{SPRING}$, of the bias spring 146 acting on the paddle 148. It will be appreciated by those skilled in the art that, of these three torques, the most controllable is that due to the adjustable bias spring 146 of the invention. This is typically done by adjusting the length of the bias spring 146. The cross member of the turned-in spring end 172 allows a suitable adjusting tool (not shown) to grab the bias spring 146 and rotate it within the threaded insert 166. Since the spring pitch is slightly undersized relative to the pitch of the threaded insert 166, rotation of the bias spring 146 causes it to wind itself into and/or out of the insert 166 and to extend the length of such spring 146 slightly at the minor diameter end 170. This extension in the minor diameter 170 induces friction between the wire of the spring 146 and the internal thread of the insert 166 to prevent the adjustment from changing during normal operation of the circuit breaker 20'. Increasing (decreasing) the free length of the bias spring 146 between the assembly formed by the deck 162, the threaded insert 166 and the trip bar paddle 148 causes the load between such spring 146 and the trip bar paddle 148, $F_{SPRING}$, to increase (decrease) proportionally. The force $F_{SPRING}$ directly affects torque on the trip bar 80'. An assembly operator is then able to adjust the spring load and measure (e.g., using a load cell) latch load resulting from that change.

Figure 3:
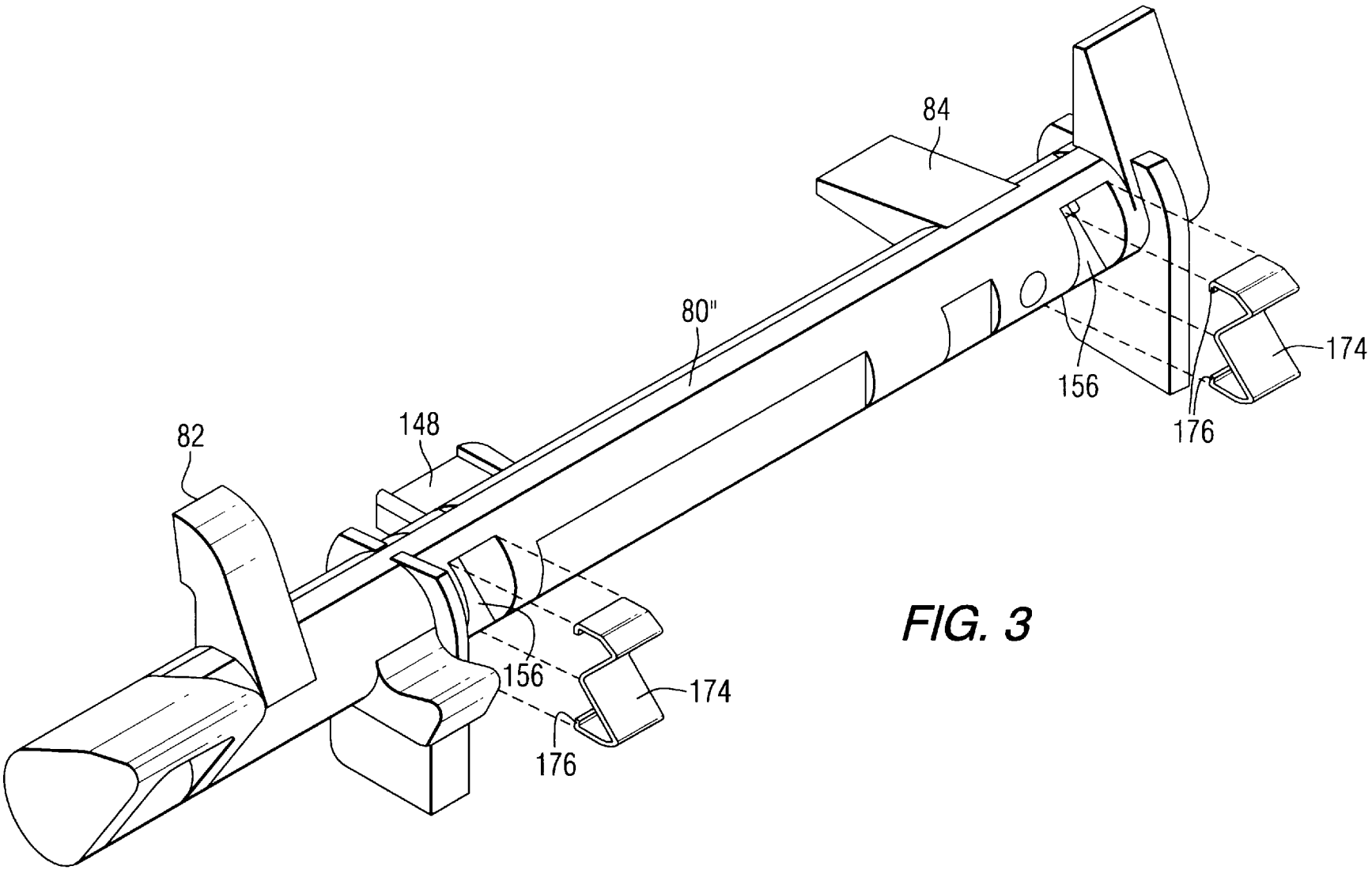
FIG. 3 an exploded isometric view of the trip bar constructed in accordance with the preferred embodiment of the present invention.

FIG. 3 an exploded isometric view of the trip bar 80" constructed in accordance with the preferred embodiment of the present invention. Trip bar 80" is preferably made of an insulating material to prevent the conduction of electric current between internal parts of the circuit breaker. In the preferred embodiment of the invention, the trip bar is a compression molded glass reinforced plastic material. Although compression molded glass reinforced plastic is a relatively wear resistant material, repeated movement of the trip bar about the pivot points on the circuit breaker side plates can result in wear of the pivot pockets in the trip bar. Such wear can result in the trip bar being displaced from its normal operating position, thereby affecting performance of the trip mechanism. In order to reduce wear in the pivot pockets 156 of the trip bar, metal clips 174, which are shaped to fit within the pivot pockets, are installed on the trip bar 80". The metal clips are preferably made of cold rolled steel and include inward facing flanges 176 at each end to latch onto the trip bar. The clips preferably have spring characteristics so that they clamp onto the trip bar when installed. The metal clips are significantly harder than the glass reinforced plastic that comprises the body of the trip bar.

Figure 4:
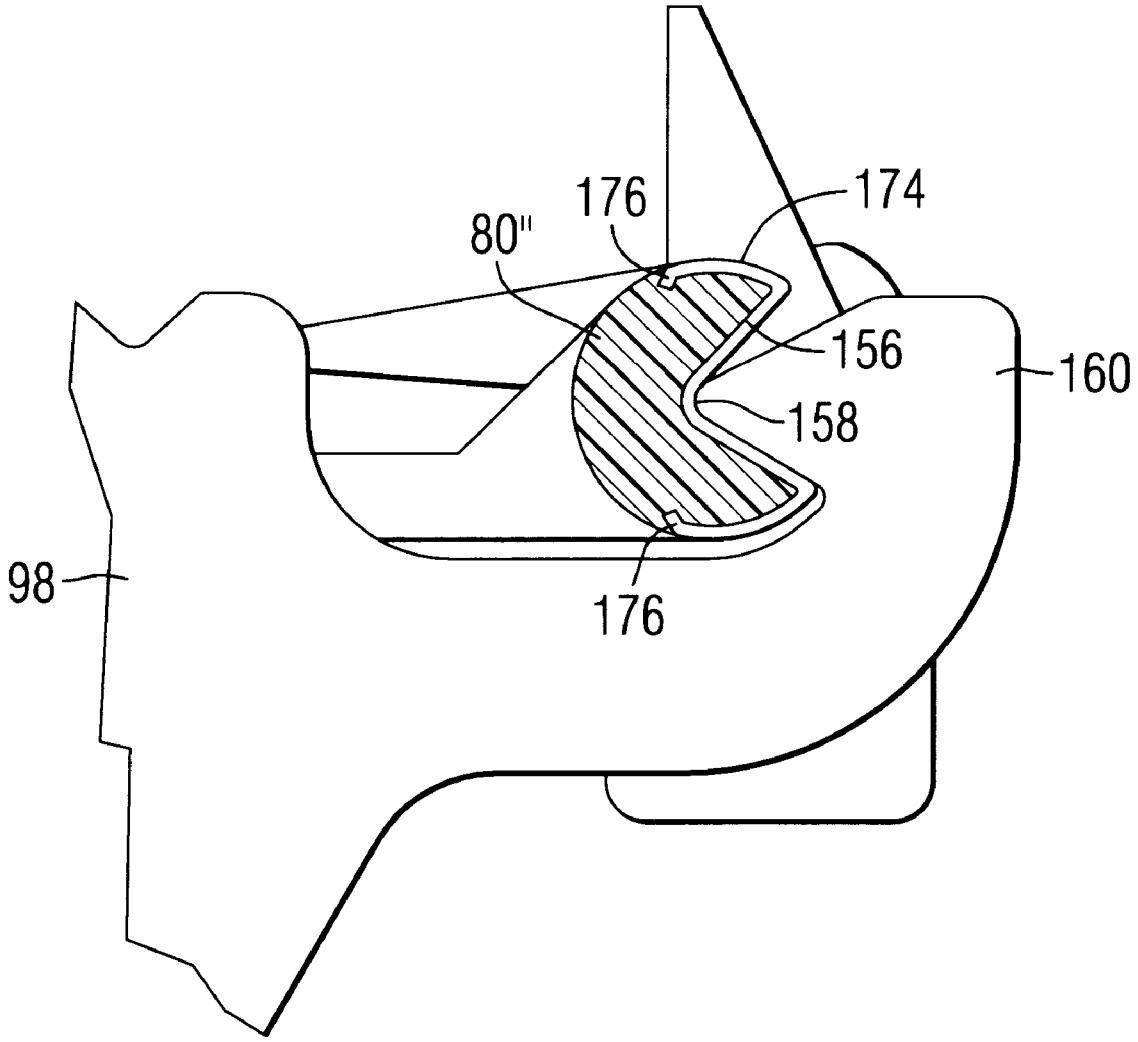
FIG. 4 is a cross-sectional view of the trip bar of FIG. 3 taken in the vicinity of a pivot point of an end plate of a circuit breaker.

FIG. 4 is a cross-sectional view of the trip bar 80" of FIG. 3 taken in the vicinity of a pivot point of an end plate of a circuit breaker. FIG. 4 shows that the spring clips 174 make contact with the pivot point 158, thereby preventing contact between the pivot point and the glass reinforced plastic used to make the trip bar 80". The flanges 176 on the clips lock into recesses in the trip bar to secure the clips to the trip bar. The frictional force $F_{FRICTION}$ acts on the clip, not on the glass reinforced plastic. Since the clips provide the bearing surface for the side plate pivot points, and are harder that the glass reinforced plastic of the body of the trip bar, this substantially reduces wear in the pivot pockets of the trip bar.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. An electrical circuit breaker comprising:

a housing;

separable contacts housed by said housing and moveable between a closed position and an open position;

operating means for moving said separable contacts between the closed position and the open position thereof, said operating means having a first position and a second position corresponding to the open position of said separable contacts;

means for latching said operating means in the first position thereof and for releasing said operating means to the second position thereof;

a trip bar movable in a first direction and a second direction for unlatching said means for latching, said trip bar including first and second pivot pockets for pivotally mounting said trip bar within said housing;

means for sensing an electrical condition associated with said separable contacts and for moving said trip bar in the second direction in order to unlatch said means for latching, to release said operating means to the second position thereof, and to move said separable contacts to the open position thereof; and first and second clips respectively positioned in said first and second pivot pockets for providing bearing surfaces in said trip bar.

2. The circuit breaker as recited in claim 1 wherein said first and second clips each include a pair of flanges for securing the first and second clips to the trip bar, said flanges being positioned in grooves of the trip bar.

3. The circuit breaker as recited in claim 1 wherein said first and second clips are comprised of cold rolled steel and said trip bar is comprised of glass reinforced plastic.

4. The circuit breaker as recited in claim 1 wherein said first and second clips each conform to a surface of the pivot pocket in which the clips are positioned.

5. The circuit breaker as recited in claim 1 further comprising:

first and second side plates mounted within said housing, each of said first and second side plates including a pivot point extending into one of said pivot pockets in said trip bar, and each of said pivot points contacting one of said clips.

6. The circuit breaker as recited in claim 1 wherein said pivot pockets have substantially flat sides.

7. An electrical circuit breaker comprising:

a housing;

separable contacts housed by said housing and moveable between a closed position and an open position;

an operating mechanism means for moving said separable contacts between the closed position and the open position thereof, said operating mechanism having a first position and a second position corresponding to the open position of said separable contacts;

a latch for latching said operating mechanism in the first position thereof and for releasing said operating mechanism to the second position thereof;

a trip bar movable in a first direction and a second direction for unlatching said latch, said trip bar including first and second pivot pockets for pivotally mounting said trip bar within said housing;

a trip unit for sensing an electrical condition associated with said separable contacts and for moving said trip bar in the second direction in order to unlatch said latch, to release said operating mechanism to the second position thereof, and to move said separable contacts to the open position thereof; and first and second clips respectively positioned in said first and second pivot pockets for providing bearing surfaces in said trip bar.

8. The circuit breaker as recited in claim 7 wherein said first and second clips each include a pair of flanges for securing the first and second clips to the trip bar, said flanges being positioned in grooves of the trip bar.

9. The circuit breaker as recited in claim 7 wherein said first and second clips are comprised of cold rolled steel and said trip bar is comprised of glass reinforced plastic.

10. The circuit breaker as recited in claim 7 wherein said first and second clips each conform to a surface of the pivot pocket in which the clips are positioned.

11. The circuit breaker as recited in claim 7 further comprising:

first and second side plates mounted within said housing, each of said first and second side plates including a pivot point extending into one of said pivot pockets in said trip bar, and each of said pivot points contacting one of said clips.

12. The circuit breaker as recited in claim 7 wherein said pivot pockets have substantially flat sides.

* * * * *